US005440900A

United States Patent [19]

White

[11] Patent Number: 5,440,900

[45] Date of Patent: Aug. 15, 1995

[54] ADD-ON JEWELRY ITEM FOR FLEXIBLE JEWELRY CHAINS

[75] Inventor: Howard H. White, Staten Island, N.Y.

[73] Assignee: Omega Casting Corp., New York, N.Y.

[21] Appl. No.: 81,019

[22] Filed: Jun. 22, 1993

[51] Int. Cl.[6] ..... A44C 25/00

[52] U.S. Cl. ..... 63/2

[58] Field of Search ..... 63/2, 21; 24/115 H, 24/116 A

[56] References Cited

U.S. PATENT DOCUMENTS

| | | | |
|---|---|---|---|
| 996,678 | 7/1911 | Reynolds . | |
| 1,069,254 | 8/1913 | Henning . | |
| 1,412,810 | 4/1922 | Rosenthal . | |
| 1,529,257 | 3/1925 | Lampl | 63/2 |
| 1,578,940 | 3/1926 | Wacha | 24/116 A |
| 2,058,358 | 10/1936 | Schmidt . | |
| 2,571,674 | 10/1951 | Braunstein . | |
| 2,586,758 | 2/1952 | Zerr . | |
| 2,595,462 | 5/1952 | Johnson | 24/116 A |
| 2,615,313 | 10/1952 | Schaeffer . | |
| 2,637,884 | 5/1953 | Morehouse | 24/115 H |
| 2,668,605 | 2/1954 | Schaeffer . | |
| 2,830,347 | 4/1958 | Waller . | |
| 3,168,768 | 2/1965 | Bohlinger et al. | 63/2 |
| 3,192,737 | 6/1965 | Schecter et al. . | |
| 3,347,037 | 10/1967 | Klang . | |
| 3,974,545 | 8/1976 | Lossini . | |
| 4,530,221 | 7/1985 | Weinberg . | |
| 4,542,630 | 9/1985 | Nanasi et al. | 63/2 |
| 4,611,368 | 9/1986 | Battersby | 63/2 |
| 4,628,708 | 12/1986 | Ivey | 63/2 |
| 4,754,534 | 7/1988 | Helwick | 63/2 |
| 4,878,269 | 11/1989 | Anscher et al. . | |
| 4,912,814 | 4/1990 | McKenzie | 24/115 H |
| 5,214,940 | 6/1993 | Capifali | 63/2 |
| 5,351,505 | 10/1994 | Febrer . | |

FOREIGN PATENT DOCUMENTS

| | | |
|---|---|---|
| 0783269 | 7/1935 | France . |

*Primary Examiner*—Michael J. Milano

*Attorney, Agent, or Firm*—Levisohn, Lerner, Berger & Langsam

[57] ABSTRACT

An add-on jewelry item for attachment to flexible chains is disclosed in which the add-on item has an open back. The add-on item is capable of being attached by ordinary consumers to flexible chains, so that add-on jewelry items can be more easily employed and sold for lower cost because the skills of an expert jeweler will not be required to assemble and attach the add-on jewelry to the flexible chain. Numerous embodiments illustrating various ways of securing the add-on item to flexible chains are disclosed.

7 Claims, 3 Drawing Sheets

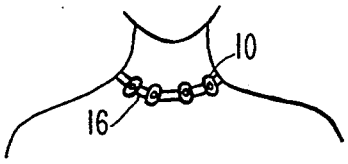
FIG. 1
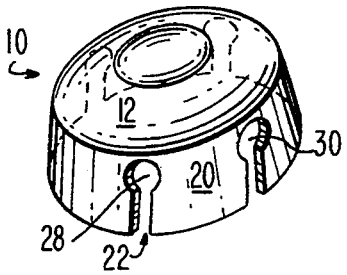
FIG. 2
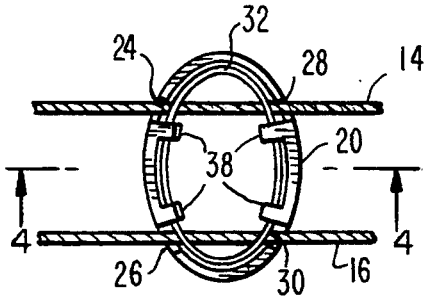
FIG. 3
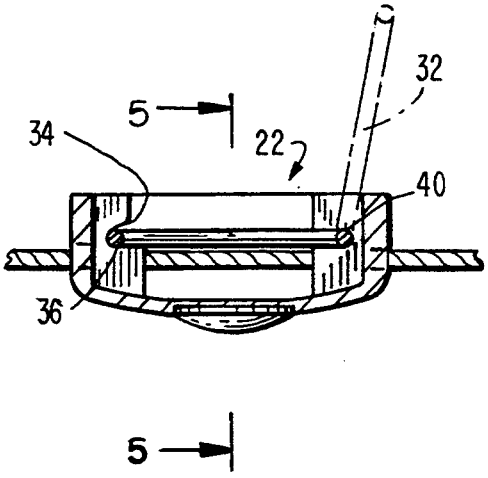
FIG. 4
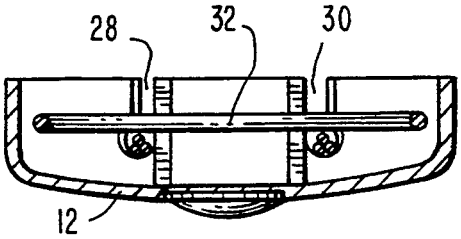
FIG. 5
FIG. 6
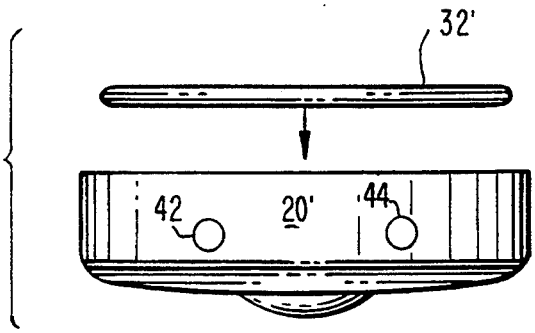

ADD-ON JEWELRY ITEM FOR FLEXIBLE JEWELRY CHAINS

This invention relates to a novel jewelry item, and in particular, to a jewelry item which is to be added onto bracelets or necklaces made of flexible jewelry chain.

Bracelets made of jewelry chains are often adorned with jewelry ornaments. Often, these ornaments are attached to the chain and are generally held fixedly in place. Because there are large unused areas of the flexible chain, an attractive jewelry item is an add-on which is able to be attached to the chain so as to enhance the ornamental appearance of the bracelet and its value.

With regard to fine jewelry, add-on jewelry items are generally attached to a bracelet only by a jeweler. This is generally accomplished by provision of a jewelry item through which the jewelry chain is be passed from side to side with the rear of the jewelry item removed to allow the jeweler to manipulate the jewelry chain through the jewelry item. The rear is thereafter secured to the jewelry item and compressible materials are secured therein to hold the jewelry item fixedly in place on the jewelry chain where it is assembled.

Add-on jewelry items have become increasingly popular, but the need to have such add-on items installed by a qualified jeweler increases the cost and detracts from the overall popularity of such items.

An object of this invention is to reduce the need for skilled labor to add such jewelry items onto jewelry chains.

Another object of this invention is to enable the consumer to add-on such jewelry items.

Still another object of this invention is to lighten the weight of the add-on item of jewelry both to reduce its cost and to increase its popularity.

Yet another object of this invention is to provide such an add-on jewelry item which may easily be attached to existing single or multiple flexible jewelry chains without requiring the services of a jeweler.

Another object of this invention is to provide such a jewelry item which is easy to manufacture, easy to use and will find widespread acceptance.

Other objects, advantages and features of this invention will become more apparent from the following description.

SUMMARY OF THE INVENTION

In accordance with the principles of this invention, a jewelry item is presented which is capable of being fixedly attached to a jewelry chain. Preferably the jewelry chain is a double strand jewelry chain, and the jewelry item has a front or facing surface. The jewelry item has an open rear and further comprises side wails through which the jewelry chain passes. In one embodiment, a retaining means cooperates with the jewelry chain which passes between the side wails of the jewelry item and the retaining means is press fit against the jewelry chain securely holding the jewelry item in place on the jewelry chain. The retaining ring may be hingedly connected to the jewelry item or may be separable, and it is snapped into place to fixedly hold the jewelry item in place on the jewelry chain.

BRIEF DESCRIPTION OF THE DRAWINGS

FIG. 1 is a front view of a person wearing a double chain necklace with a plurality of jewelry items attached thereon;

FIG. 2 is a perspective view of an embodiment of this invention;

FIG. 3 is a rear view of an embodiment of this invention showing a double chain passing therethrough;

FIG. 4 is a an end view through of another embodiment of the jewelry item of this invention showing a hinged version of the retaining means;

FIG. 5 is a sectional view taken along lines 5—5 of FIG. 4;

FIG. 6 is an end view showing another embodiment of this invention with the retaining means being separable from the jewelry item;

DETAILED DESCRIPTION

Figure 7:
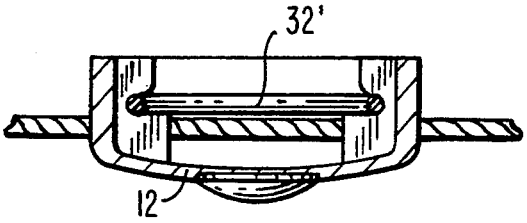
FIG. 7 is a sectional view of the embodiment of FIG. 6 showing the retaining means attached to the jewelry item.

The jewelry item 10 is shown in FIG. 2 has a front display surface 12, with the jewelry item 10 shown attached to a pair of flexible chain members 14 and 16 (FIG. 3), generally being parallel to each other. Flexible chains 14 and 16 pass through the side walls 18 and 20 of the jewelry item. The rear 22 of the jewelry item is open, and a pair of slots 24 and 26 as well as 28 and 30 are formed in the opposite side walls 18 and 20 of the jewelry item. Slots 24 and 28 are opposite each other on opposite side walls as are slots 26 and 30. The slots 24–30 are formed open to the rear to enable the flexible chain to be dropped into the slots 24, 26, 28 and 30 as will be described hereinafter.

In order to attach the jewelry item to the chains, the chains are passed through the slots 24, 26, 28 and 30, and a spring or retaining means 32 is press fit in the rear 22 of the jewelry item and moves over a camming surface 34, as illustratively shown in FIG. 4 to snap into a slot 36 formed thereunder and hold the jewelry item in place on the flexible chain with the spring member 32 bearing against the flexible chain passing under slot 36.

FIG. 3 illustrates one embodiment of the retaining ring 32 and rear 22 of the jewelry item in which the retaining ring is substantially oval to conform to the shape of the jewelry item, and the retaining ring is deformed and fits under four abutments 38 to be fixedly held in place and bear against the captured jewelry chain 14 and 16.

FIG. 4 illustrates another embodiment of this invention in which the retaining member 32 is hingedly held as at 40 to the jewelry item enabling the retaining member to be snapped into place under cam surface 34 into slot 36 and to be removed therefrom to allow the chain free movement with respect to the jewelry item to reset the jewelry item on the chain.

FIG. 6 illustrates yet another embodiment of this invention in which the retaining ring 32′ which is separable from the jewelry item. Note that the separable retainer ring 32′ is not hinged as at 40 and is intended to be sold as a separable element apart from the jewelry item which is attached in the rear 22 of the jewelry item to secure the jewelry item to the flexible chain. Additionally the side wall 20′ of the embodiment of the jewelry item shown in FIG. 6 includes a pair of apertures 42 and 44 which are different from slots 28 and 30 shown in FIG. 2. With the embodiment of FIG. 6, the jewelry chain is allowed to pass through apertures 42 and 44 as well as through a pair of apertures located opposite to 42 and 44 (not shown) prior to snapping retaining ring or member 32′ in place in the rear 22 of the jewelry item. (See FIG. 7).

Figure 8:
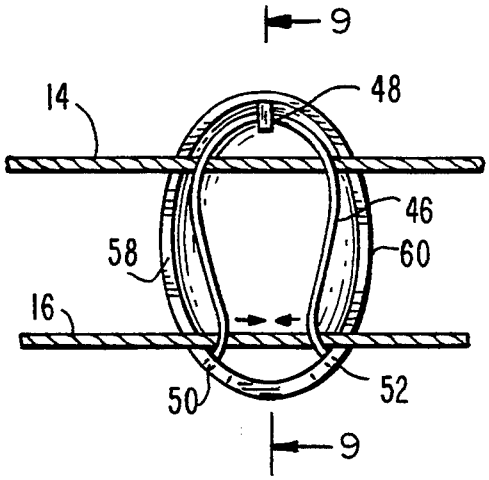
FIG. 8 is a rear view of another embodiment of this invention showing a U-shaped retaining means.
Figure 9:
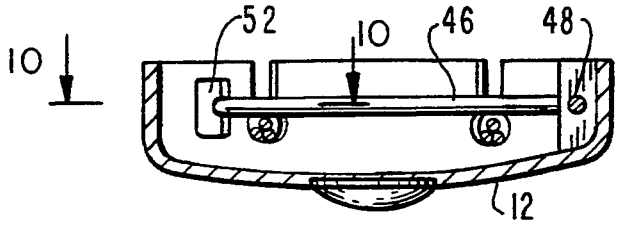
FIG. 9 is a sectional view taken along lines 9—9 of FIG. 8.
Figure 10:
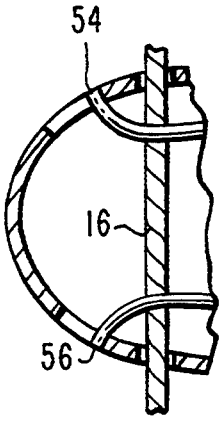
FIG. 10 is an enlarged view of the bottom portion of the retaining means of FIG. 8 showing the legs passing through the side walls of the jewelry item.

FIGS. 8–10 illustrate another embodiment of this invention in which the retaining member is a U-shaped spring 46 hinged at 48 to the jewelry item with legs 50 and 52 adapted to fit in slots or holes 54 and 56, respectively, formed in the side walls 58 and 60 respectively of the jewelry item. In this embodiment, the flexible chains are dropped into slots 24, 26, 28 and 30 as per FIGS. 2 and 3, and the retaining member 46 is snapped in place by engaging legs 50 and 52 with slots 54 and 56, respectively, to securely hold the jewelry item on the chains 14 and 16.

Figure 12:
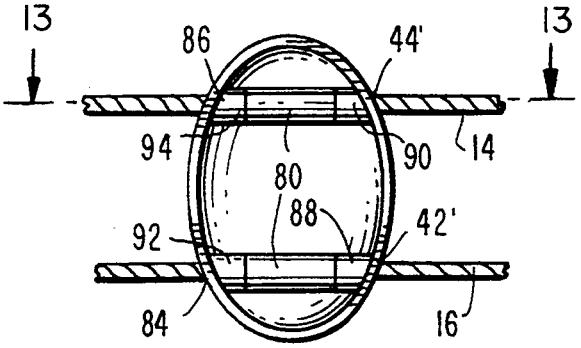
FIG. 12 is a sectional view taken along lines 12—12 of FIG. 11.
Figure 11:
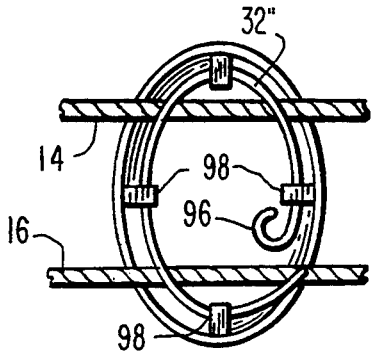
FIG. 11 is a rear view of another embodiment of this invention.

FIGS. 11 and 12 illustrate another embodiment of this invention in which a plastic cylindrical tube 80 having an opening 82 therethrough is provided through which the chains 14 and 16 pass through abutments 88, 90, 92 and 94, as well as the chains passing through apertures 42′, 44′, 84 and 86 respectively in the side walls of the jewelry item. The abutments provide a guide allowing the flexible chain to pass through, for instance, aperture 42′, through plastic slide 80 and through aperture 84 so that each chain passes through the jewelry item. The opening 82 is sufficient to allow the chain to be pulled therethrough yet frictionally held therein.

Figure 13:
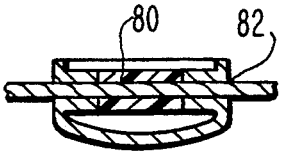
FIG. 13 is a rear view of another embodiment of this invention.

FIG. 13 illustrates yet another embodiment of this invention in which the retaining means 32″ is formed as partial loop having a hook 96 at the end. The hook allows one to easily manipulate the retaining ring to be moved out from under abutments 98 which hold the retaining member in place, thereby to permit the retaining member to be moved away from the chains 14 and 16 so as to allow the jewelry item to be fixedly reset on the jewelry chain.

Figure 14:
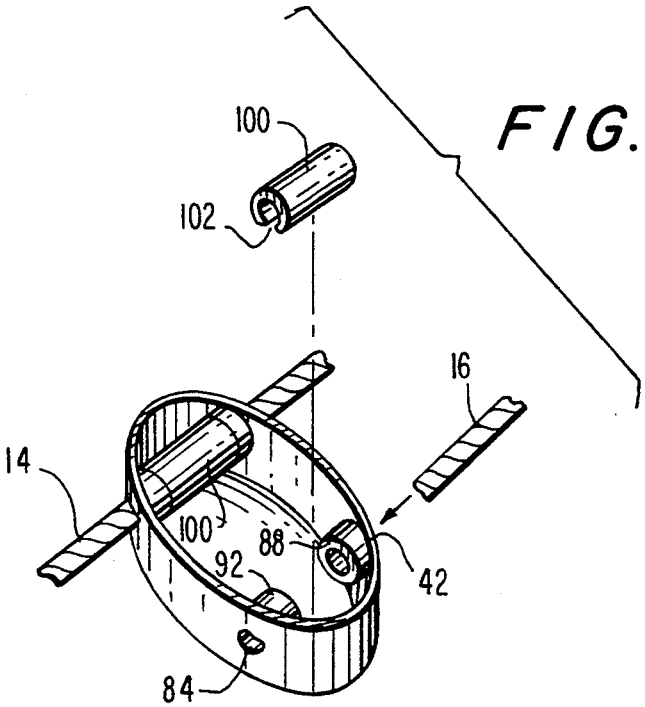
FIG. 14 is an exploded perspective view of yet another embodiment of this invention.

FIG. 14 is an exploded perspective view of yet another embodiment of this invention somewhat similar to that shown in FIGS. 11 and 12. In this embodiment, the plastic member 100 has an opening 102 in the bottom thereof, so that the chain 14 and 16 can be slid through the respective openings (42′ abutments 88 and 92 and aperture 84), after which the plastic spacer member 100 is snapped fit onto the chain to be fixedly held in place thereby holding the chain in place as well as the chain to the jewelry item.

As stated above, one of the objects of this invention is to lessen the weight of the jewelry item to make it less expensive. The rear of the jewelry item is open, and this is different from prior add-on jewelry items, with the open aspect of the jewelry item lessening the gold content and weight thereof to reduce the price thereof.

This invention has been described with several preferred embodiments, and while this invention has been described with such embodiments, the protection afforded such invention is set forth in the appended claims. One of ordinary skill in the art may alter the embodiments to produce different versions of this invention without departing from the spirit or scope of the claims appended hereto.

What is claimed is:

1. A jewelry item to be added to a jewelry chain and to be held in place on said chain, said jewelry item comprising:
   - a display front surface and a rear portion,
   - a side wall integrally formed with said front surface, said chain passable through said side wall; and,
   - retaining means insertable and holdable in the rear of said jewelry item and bearing against said chain to hold said jewelry item in place on said chain, said retaining means comprising deformable cylindrical members having an opening therethrough through which said chain is press fit to be fixedly held thereon.

2. A jewelry item as in claim 1, wherein said cylindrical members are plastic.

3. A jewelry item to be added to a jewelry chain and to be held in place on said chain, said jewelry item comprising:
   - a display front surface and a rear portion,
   - a side wall integrally formed with said front surface through which said chain passes; slots in said side wall through which said chain passes, said slots located oppositely to each other,
   - slide means sized to fit within the rear of said jewelry item, between said slots, said slide means having an opening therethrough through which said chain also passes, said slide means firmly holding said chain in place when said slide means is located between said slots.

4. A jewelry item according to claim 3, wherein said slide means comprises plastic.

5. A jewelry item according to claim 3, wherein said slots comprise two pairs of slots, each of said pairs of slots being located oppositely to each other.

6. A jewelry chain and jewelry item, said jewelry item to be selectively added to said jewelry chain and to be held in place on said chain, said jewelry item comprising:
   - a display front surface and a rear portion,
   - a side wall integrally formed with said front surface,
   - slots in said side wall through which said chain passes, said slots located oppositely to each other, and
   - slide means sized to fit in the rear of said jewelry item between said slots, said slide means having an opening therethrough through which said chain passes; said slide means firmly holding said chain in place when said slide means is located between said slots.

7. A jewelry item according to claim 6, wherein said slots comprise two pairs of opposite slots, each of said pairs of slots being located oppositely to each other, and said chain comprises at least two flexible chains.

* * * * *